US008851596B2

(12) United States Patent
Nakamura

(10) Patent No.: US 8,851,596 B2
(45) Date of Patent: Oct. 7, 2014

(54) IMAGE FORMING APPARATUS INCLUDING RECORDING HEAD AND HEAD TANK

(71) Applicant: Daisuke Nakamura, Kanagawa (JP)

(72) Inventor: Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/795,052

(22) Filed: Mar. 12, 2013

(65) Prior Publication Data

US 2013/0286061 A1 Oct. 31, 2013

(30) Foreign Application Priority Data

Apr. 26, 2012 (JP) ..... 2012-100678

(51) Int. Cl.
*B41J 2/195* (2006.01)
*B41J 2/175* (2006.01)
*B41J 29/38* (2006.01)

(52) U.S. Cl.
CPC ..... *B41J 2/175* (2013.01); *B41J 2/17566* (2013.01); *B41J 29/38* (2013.01); *B41J 2/17509* (2013.01); *B41J 2/17513* (2013.01)
USPC ..... 347/7; 347/19; 347/85

(58) Field of Classification Search
CPC ..... B41J 2/17506; B41J 2002/17516
See application file for complete search history.

(56) References Cited

U.S. PATENT DOCUMENTS 6,155,664 A * 12/2000 Cook ..... 347/7
2002/0149633 A1* 10/2002 Murakami et al. ..... 347/7
2007/0109362 A1 5/2007 Hori et al.
2008/0291240 A1 11/2008 Ohsako et al.
2010/0026742 A1* 2/2010 Morino ..... 347/7
2011/0141209 A1 6/2011 Tsukamura et al.
2011/0228016 A1 9/2011 Nakamura
2012/0056953 A1 3/2012 Nakamura
2012/0306950 A1* 12/2012 Kobayashi et al. ..... 347/7
2013/0147867 A1* 6/2013 Kobayashi et al. ..... 347/7

FOREIGN PATENT DOCUMENTS

| | | |
|---|---|---|
| JP | 3-007350 | 1/1991 |
| JP | 6-183023 | 7/1994 |
| JP | 11-240171 | 9/1999 |
| JP | 2001-358292 | 12/2001 |
| JP | 2002478531 | 6/2002 |
| JP | 2002-273905 | 9/2002 |
| JP | 2002-321379 | 11/2002 |
| JP | 2003-191495 | 7/2003 |
| JP | 2003-001846 | 11/2003 |
| JP | 2005-059274 | 3/2005 |

* cited by examiner

*Primary Examiner* — Shelby Fidler
(74) *Attorney, Agent, or Firm* — Cooper & Dunham LLP

(57) ABSTRACT

An image forming apparatus includes an apparatus body, a recording head, a head tank, a displacement member, an air release unit, a main tank, a liquid feed device, a body-side detector, and a supply controller. The supply controller controls a normal filling operation to start feeding liquid from the main tank to the head tank without opening the air release unit when a consumption amount of the liquid in the head tank is a threshold amount or greater, and stop feeding the liquid from the main tank to the head tank when the body-side detector detects an arrival of the displacement member at a normal fill position. When the body-side detector detects the displacement member at a start of the normal filling operation, the supply controller corrects the normal fill position to a position at which the liquid feed device can feed the liquid to the head tank.

3 Claims, 19 Drawing Sheets

IMAGE FORMING APPARATUS INCLUDING RECORDING HEAD AND HEAD TANK

CROSS-REFERENCE TO RELATED APPLICATIONS

This patent application is based on and claims priority pursuant to 35 U.S.C. §119 to Japanese Patent Application No. 2012-100678, filed on Apr. 26, 2012, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets and a head tank for supplying liquid to the recording head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, inkjet recording apparatuses are known that use a recording head (liquid ejection head or droplet ejection head) for ejecting droplets of ink or other liquid.

Such a liquid-ejection-type image forming apparatus may have a head tank (also referred to as sub tank or buffer tank) to supply ink to the recording head, and the head tank has a function (mechanism) to create a negative pressure to prevent ink from seeping or dropping from nozzles of the recording head.

For example, JP-4190001-B1 (JP-2005-059274-A) proposes an image forming apparatus including a head tank (sub tank), a main tank, a full state detector, and a controller. The head tank includes a deformable film member forming at least one face of the head tank, an elastic member to urge the film member outward, a negative pressure generation unit to generate a negative pressure in the head tank by expansion and contraction in response to liquid supply and discharge, a displacement member contacting an outer face of the film member and displaceable with deformation of the film member, and an air release unit to open an interior of the head tank to the atmosphere. The main tank supplies liquid to the head tank. The full state detector detects the position of the displacement member of the head tank. The controller opens the air release unit to release the interior of the head tank to the atmosphere and supplies liquid from the main tank to the head tank with the air release unit opened. Then, the controller closes the air release unit and contracts the negative pressure generation unit by discharging a part of liquid from the head tank to generate a negative pressure in the head tank. When the negative pressure is generated in the head tank, the controller stores a current position of the displacement member (also referred to as feeler) as a normal fill feeler position. During liquid supply from the main tank to the head tank with the air release unit closed, the controller stops the liquid supply when the displacement member arrives at the normal fill feeler position stored.

However, for the configuration of JP-4190001-B1 (JP-2005-059274-A) in which, with the air release unit closed, liquid is filled (supplied from the main tank to the head tank) till the displacement member arrives at the normal fill feeler position stored, if the normal fill feeler position is beyond a displaceable range of the displacement member, the displacement member may not move with consumption of liquid in the head tank, thus hampering proper liquid filling (i.e., the controller determines that liquid filling has been completed and does not perform liquid filling).

When liquid is fully filled to the head tank with the air release unit opened, the controller stores a current position of the displacement member as a liquid full position (liquid full feeler position). However, the liquid full position of the displacement member may vary with the number of operation of the film member or ambient environment. As a result, even if the discharge amount of liquid discharged from the head tank to create a negative pressure in the head tank is constant, the normal fill feeler position may be beyond the displaceable range of the displacement member.

In such a case, since liquid in the head tank is consumed without the replenishment (filling) of liquid, liquid may run out in the head tank or an excessive negative pressure may be created in the head tank, thus causing ejection failure.

BRIEF SUMMARY

In an aspect of this disclosure, there is provided an image forming apparatus including an apparatus body, a recording head, a head tank, a displacement member, an air release unit, a main tank, a liquid feed device, a body-side detector, and a supply controller. The recording head ejects droplets of liquid. The head tank is mounted to the recording head to store the liquid therein and supply the liquid to the recording head. The displacement member is disposed at the head tank and displaceable with a remaining amount of the liquid in the head tank. The air release unit is disposed at the head tank to open an interior of the head tank to an atmosphere. The main tank is removably mounted to the apparatus body to store the liquid therein and supply the liquid to the head tank. The liquid feed device feeds the liquid from the main tank to the head tank. The body-side detector is disposed at the apparatus body to detect the displacement member. The supply controller controls the liquid feed device to supply the liquid from the main tank to the head tank. The supply controller controls a normal fill position acquisition operation to open the air release unit, feed the liquid to the head tank with the interior of the head tank open to the atmosphere, discharge a predetermined amount of the liquid from the head tank, detect with the body-side detector a current position of the displacement member after the predetermined amount of the liquid is discharged from the head tank, and retain the detected current position of the displacement member as a normal fill position. The supply controller further controls a normal filling operation to start feeding the liquid from the main tank to the head tank without opening the air release unit when a consumption amount of the liquid in the head tank is a threshold amount or greater, and stop feeding the liquid from the main tank to the head tank when the body-side detector detects an arrival of the displacement member at the normal fill position. When the body-side detector detects the displacement member at a start of the normal filling operation, the supply controller corrects the normal fill position to a position at which the liquid feed device can feed the liquid to the head tank.

In another aspect of this disclosure, there is provided an image forming apparatus including an apparatus body, a recording head, a head tank, a displacement member, an air release unit, a main tank, a liquid feed device, a body-side detector, and a supply controller. The recording head ejects droplets of liquid. The head tank is mounted to the recording head to store the liquid therein and supply the liquid to the recording head. The displacement member is disposed at the head tank and displaceable with a remaining amount of the liquid in the head tank. The air release unit is disposed at the head tank to open an interior of the head tank to an atmosphere. The main tank is removably mounted to the apparatus body to store the liquid therein and supply the liquid to the head tank. The liquid feed device feeds the liquid from the main tank to the head tank. The body-side detector is disposed at the apparatus body to detect the displacement member. The supply controller controls the liquid feed device to supply the liquid from the main tank to the head tank. The supply controller controls a normal fill position acquisition operation to open the air release unit, feed the liquid to the head tank with the interior of the head tank open to the atmosphere, discharge a first predetermined amount of the liquid from the head tank, detect with the body-side detector a current position of the displacement member after the first predetermined amount of the liquid is discharged from the head tank, and retain the detected current position of the displacement member as a normal fill position. The supply controller further controls a normal filling operation to start feeding the liquid from the main tank to the head tank without opening the air release unit when a consumption amount of the liquid in the head tank is a threshold amount or greater, and stop feeding the liquid from the main tank to the head tank when the body-side detector detects an arrival of the displacement member at the normal fill position. When the body-side detector detects the displacement member at a start of the normal filling operation, the supply controller controls a reacquisition operation to acquire the normal fill position again.

In still another aspect of this disclosure, there is provided an image forming apparatus including an apparatus body, a recording head, a head tank, a displacement member, an air release unit, a main tank, a liquid feed device, a body-side detector, and a supply controller. The recording head ejects droplets of liquid. The head tank is mounted to the recording head to store the liquid therein and supply the liquid to the recording head. The displacement member is disposed at the head tank and displaceable with a remaining amount of the liquid in the head tank. The air release unit is disposed at the head tank to open an interior of the head tank to an atmosphere. The main tank is removably mounted to the apparatus body to store the liquid therein and supply the liquid to the head tank. The liquid feed device feeds the liquid from the main tank to the head tank. The body-side detector is disposed at the apparatus body to detect the displacement member. The supply controller controls the liquid feed device to supply the liquid from the main tank to the head tank. The supply controller controls a normal fill position acquisition operation to open the air release unit, feed the liquid to the head tank with the interior of the head tank open to the atmosphere, detect a first current position of the displacement member with the body-side detector, retain the detected first current position of the displacement member as an air release position, discharge the liquid from the head tank till the displacement member is placed at a nondisplaceable position, detect with the body-side detector a second current position of the displacement member after the liquid is discharged from the head tank till the displacement member is placed at the nondisplaceable position, and retain the detected second current position of the displacement member as a displacement limit position and a middle position between the air release position and the displacement limit position as a normal fill position. The supply controller further controls a normal filling operation to start feeding the liquid from the main tank to the head tank without opening the air release unit when a consumption amount of the liquid in the head tank is a threshold amount or greater, and stop feeding the liquid from the main tank to the head tank when the body-side detector detects an arrival of the displacement member at the normal fill position.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIGS. 9A, 9B, 9C, 9D, 9E, 9F, 9G 9H, 91, 9J, 9K, and 9L are illustrations showing acquisition of normal fill position by a body-side sensor and normal filling operation;

FIGS. 12A, 12B, 12C, 12D, 12E, 12F, 12G, 12H, 121, 12J, 12K, and 12L are illustrations showing acquisition of normal fill position by a body-side sensor and normal filling operation in the comparative example of FIG. 11;

Figure 1:
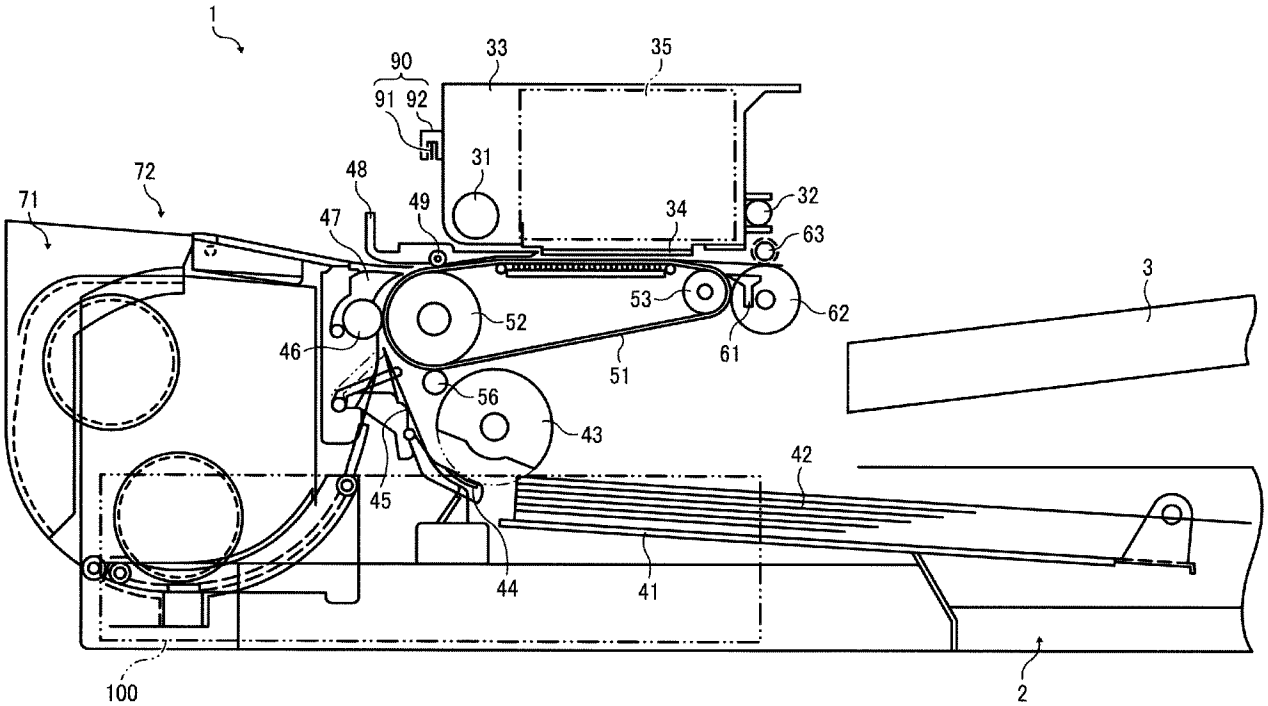
FIG. 1 is a schematic side view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted,

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium). The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a partial plan view of the image forming apparatus.

In this exemplary embodiment, the image forming apparatus is described as a serial-type inkjet recording apparatus. It is to be noted that the image forming apparatus is not limited to such a serial-type inkjet recording apparatus and may be any other type image forming apparatus. In the image forming apparatus, a carriage 33 is supported by a main guide rod 31 and a sub guide rod 32 so as to be movable in a direction (main scanning direction) indicated by an arrow MSD in FIG. 2. The main guide rod 31 and the sub guide rod 32 serving as guide members extend between a left side plate 21A and a right side plate 21B of an apparatus body 1. The carriage 33 is reciprocally moved for scanning in the main scanning direction MSD by a main scanning motor via a timing belt.

The carriage 33 mounts recording heads 34*a* and 34*b* (collectively referred to as "recording heads 34" unless distinguished) serving as liquid ejection heads for ejecting ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arranged in parallel to a direction (sub scanning direction) perpendicular to the main scanning direction and ink droplets are ejected downward from the nozzles.

Each of the recording heads 34 has two nozzle rows. For example, one of the nozzles rows of the recording head 34*a* ejects liquid droplets of black (K) and the other ejects liquid droplets of cyan (C). In addition, one of the nozzles rows of the recording head 34*b* ejects liquid droplets of magenta (M) and the other ejects liquid droplets of yellow (Y). The carriage 33 mounts head tanks 35*a* and 35*b* (collectively referred to as "head tanks 35" unless distinguished) to supply the respective color inks to the corresponding nozzle rows. A supply pump unit 24 supplies (replenishes) the respective color inks from ink cartridges 10*y*, 10*m*, 10*c*, and 10*k* removably mountable in a cartridge mount portion 4 to the head tanks 35 via supply tubes 36 dedicated for the respective color inks. An encoder scale 91 is disposed so as to extend along the main scanning direction MSD of the carriage 33. The carriage 33 mounts an encoder sensor 92 to read the encoder scale 91. The encoder scale 91 and the encoder sensor 92 form a linear encoder 90. The main scanning position (carriage position) and movement amount of the carriage 33 are detected by detection signals of the linear encoder 90.

The image forming apparatus further includes a sheet feed section to feed sheets 42 stacked on a sheet stack portion (platen) 41 of a sheet feed tray 2. The sheet feed section further includes a sheet feed roller 43 and a separation pad 44. The sheet feed roller 43 has a shape of, e.g., a substantially half moon to separate the sheets 42 from the sheet stack portion 41 and feed the sheets 42 sheet by sheet. The separation pad 44 made of a material of a high friction coefficient is disposed opposing the sheet feed roller 43 and urged toward the sheet feed roller 43.

To feed the sheet 42 from the sheet feed section to a position below the recording heads 34, the image forming apparatus includes a first guide member 45 to guide the sheet 42, a counter roller 46, a conveyance guide member 47, a pressing member 48 including a front-end pressing roller 49, and a conveyance belt 51 to adhere the sheet 42 thereon by static electricity and convey the sheet 42 to a position opposing the recording heads 34.

Figure 2:
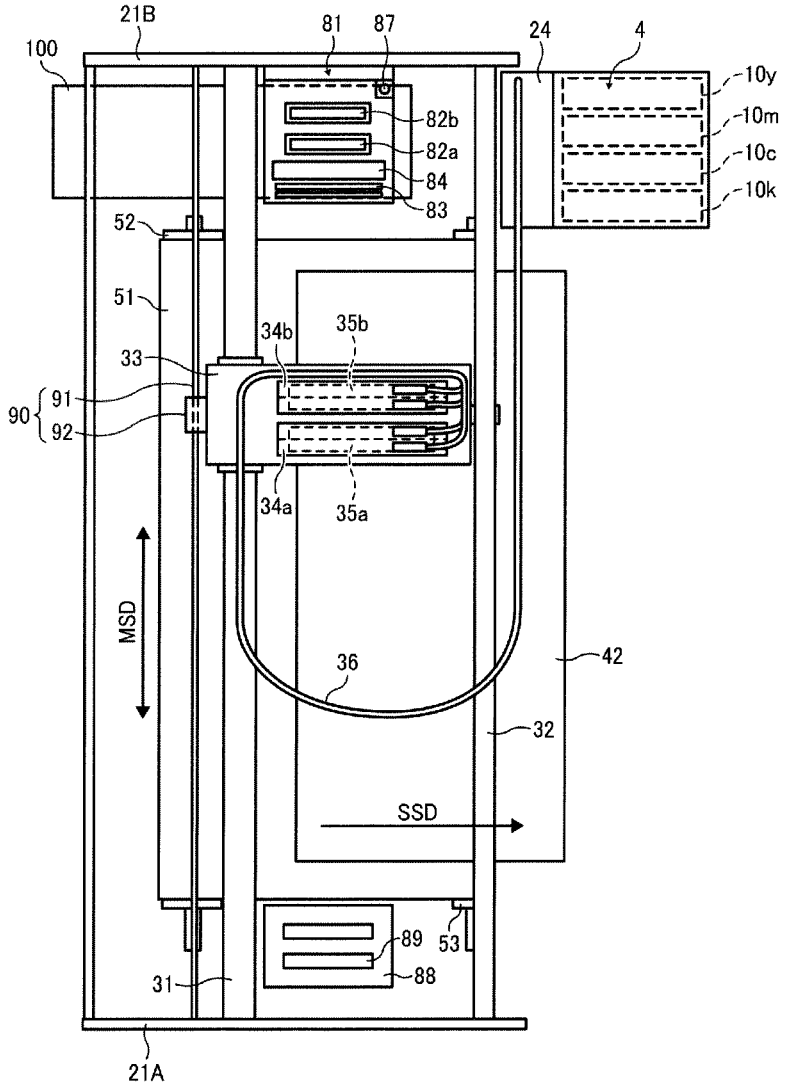
FIG. 2 is a partial plan view of the mechanical section of FIG. 1.

The conveyance belt 51 is an endless belt that is looped between a conveyance roller 52 and a tension roller 53 so as to circulate in a belt conveyance direction (sub-scanning direction indicated by an arrow SSD in FIG. 2). The image forming apparatus also has a charging roller 56 serving as a charging device to charge the surface of the conveyance belt 51. The charging roller 56 is disposed so as to contact an outer surface of the conveyance belt 51 and rotate with the circulation of the conveyance belt 51. The conveyance roller 52 is rotated by a sub scanning motor via a timing belt, so that the conveyance belt 51 circulates in the belt conveyance direction.

The image forming apparatus further includes a sheet output section that outputs the sheet 42 on which an image has been formed by the recording heads 34. The sheet output section includes a separation claw 61 to separate the sheet 42 from the conveyance belt 51, a first output roller 62, a spur 63 serving as a second output roller, and a sheet output tray 3 disposed at a position lower than the first output roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A manual feed tray 72 is formed at an upper face of the duplex unit 71.

As illustrated in FIG. 2, a maintenance device (maintenance and recovery device) 81 is disposed in a non-printing area (non-recording area) at one end in the main scanning direction of the carriage 33. The maintenance device 81 maintains and recovers nozzle conditions of the recording heads 34. The maintenance device 81 includes caps 82*a* and 82*b*, a wiping member 83, a first dummy-ejection receptacle 84, and a carriage lock 87. The caps 82*a* and 82*b* (hereinafter collectively referred to as "caps 82" unless distinguished) cap the nozzle faces of the recording heads 34. The wiping member (wiper blade) 83 wipes the nozzle faces of the recording heads 34. The first dummy-ejection receptacle 84 receives liquid droplets ejected by dummy ejection in which liquid droplets not contributing to image recording are ejected to remove viscosity-increased recording liquid. The carriage lock 87 locks the carriage 33. Below the maintenance device 81, a waste liquid tank 100 is removably mounted to the apparatus body 1 to store waste ink or liquid discharged by the maintenance and recovery operation.

As illustrated in FIG. 2, a second dummy ejection receptacle 88 is disposed at a non-printing area on the opposite end in the main scanning direction of the carriage 33. The second dummy ejection receptacle 88 receives liquid droplets ejected, e.g., during recording (image forming) operation by dummy ejection in which liquid droplets not contributing to image recording are ejected to remove viscosity-increased recording liquid. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed while being sandwiched between the conveyance belt 51 and the counter roller 46. Further, the front end of the sheet 42 is guided by the conveyance guide member 47 and is pressed against the conveyance belt 51 by the front-end pressing roller 49 to turn the transport direction of the sheet 42 by approximately 90°.

At this time, positive and negative voltages are alternately supplied to the charging roller 56 so that plus outputs and minus outputs to the charging roller 56 are alternately repeated. As a result, the conveyance belt 51 is charged in an alternating voltage pattern, that is, so that positively charged areas and negatively charged areas are alternately repeated at a certain width in the sub-scanning direction SSD, i.e., the belt conveyance direction. When the sheet 42 is fed onto the conveyance belt 51 alternately charged with positive and negative charges, the sheet 42 is adhered on the conveyance belt 51 and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, after the sheet 42 is fed by a certain distance, the recording heads 34 record another line of the image. Receiving a recording end signal or a signal indicating that the rear end of the sheet 42 has arrived at the recording area, the recording operation finishes and the sheet 42 is output to the sheet output tray 3.

To perform maintenance and recovery operation on the nozzles of the recording heads 34, the carriage 33 is moved to a home position at which the carriage 33 opposes the maintenance device 81. Then, the maintenance-and-recovery operation, such as nozzle sucking operation for sucking ink from nozzles with the nozzle faces of the recording heads 34 capped with the caps 82 and/or dummy ejection for ejecting liquid droplets not contributed to image formation, is performed, thus allowing image formation with stable droplet ejection.

Next, an example of the head tank 35 is described with reference to FIGS. 3 and 4.

Figure 3:
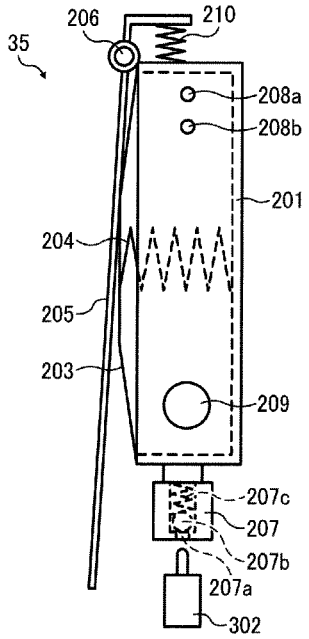
FIG. 3 is a schematic plan view of a head tank according to an exemplary embodiment of this disclosure.
Figure 4:
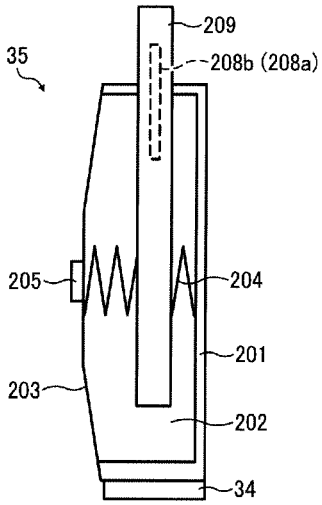
FIG. 4 is a schematic front cross sectional view of the head tank illustrated in FIG. 3.

FIG. 3 is a schematic plan view of a portion of the head tank 35 corresponding to one nozzle row. FIG. 4 is a schematic front view of the head tank 35 of FIG. 3.

The head tank 35 has a tank case 201 forming an ink accommodation part to accommodate ink and having an opening at one side. The opening of the tank case 201 is sealed with a film member 203 serving as a flexible member, and the film member 203 is constantly urged outward by a restoring force of a spring 204 serving as an elastic member disposed in the tank case 201. Thus, since the restoring force of the spring 204 acts on the film member 203 of the tank case 201, the remaining amount of ink in the ink accommodation part 202 of the tank case 201 decreases, thus creating negative pressure.

A displacement member (hereinafter, may also be referred to as simply "feeler") 205 having one end swingably supported by a support shaft 206 is disposed outside the tank case 201. The displacement member 205 is urged toward the tank case 201 by a spring 210, pressed against the film member 203, and displaces with movement of the film member 203. For example, a carriage-side sensor 251 mounted on the carriage 33 and a body-side sensor 301 mounted to the apparatus body 1 detect the displacement member 205, thus allowing detection of the remaining amount of ink or negative pressure in the head tank 35.

A supply port portion 209 is disposed at an upper portion of the tank case 201 and connected to the supply tube 36 to supply ink from the ink cartridge 10. At one side of the tank case 201, an air release unit 207 is disposed to release the interior of the head tank 35 to the atmosphere. The air release unit 207 includes an air release passage 207*a* communicated with the interior of the head tank 35, a valve body 207*b* to open and close the air release passage 207*a*, and a spring 207*c* to urge the valve body 207*b* into a closed state. An air release solenoid 302 is disposed at the apparatus body 1, and the valve body 207*b* is pushed by the air release solenoid 302 to open the air release passage 207*a*, thus causing the interior of the head tank 35 to be opened to the atmosphere (in other words, causing the interior of the head tank 35 to communicate with the atmosphere).

The head tank 35 has electrode pins 208*a* and 208*b* to detect the height of the liquid level of ink in the head tank 35. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower, i.e., the amount of air in the head tank 35 has increased to a threshold amount or more.

Figure 5:
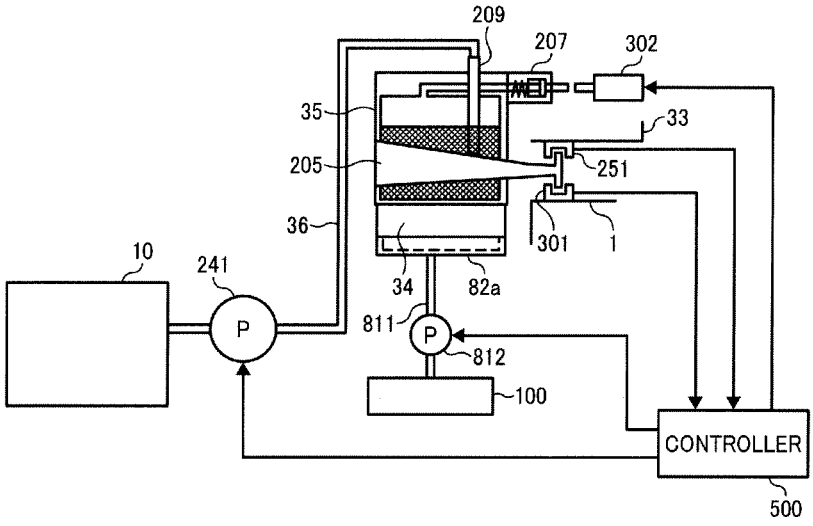
FIG. 5 is a schematic view of an ink supply-and-discharge system according to an exemplary embodiment of this disclosure.

Next, an ink supply-and-discharge system of the image forming apparatus is described with reference to FIG. 5.

A liquid feed pump 241 serving as a liquid feed device of the supply pump unit 24 feeds ink from the ink cartridge 10 (hereinafter, may also be referred to as main tank) to the head tank 35 via the supply tube 36. The liquid feed pump 241 is a reversible pump, e.g., a tube pump, capable of feeding ink from the ink cartridge 10 to the head tank 35 and returning ink from the head tank 35 to the ink cartridge 10.

The maintenance device 81, as described above, has the cap 82*a* to cover the nozzle face of any of the recording heads 34 and a suction pump 812 connected to the cap 82*a*. The suction pump 812 is driven with the nozzle face capped with the cap 82*a* to suck ink from the nozzles via a suction tube 811, thus allowing ink to be sucked from the head tank 35. Waste ink sucked from the head tank 35 is discharged to the waste liquid tank 100.

The air release solenoid 302 serving as a pressing member to open and close the air release unit 207 of the head tank 35 is disposed at the apparatus body 1. By activating the air release solenoid 302, the air release unit 207 can be opened.

On the carriage 33 is mounted the carriage-side sensor 251 serving as an optical sensor to detect the displacement member 205 of the head tank 35. On the apparatus body 1 is mounted the body-side sensor 301 serving as an optical sensor to detect the displacement member 205 of the head tank 35. Ink supply to the head tank 35 is controlled based on detection results of the carriage-side sensor 251 and the body-side sensor 301.

Driving of the liquid feed pump 241, the air release solenoid 302, and the suction pump 812 and ink supply according to exemplary embodiments of this disclosure are controlled by a controller 500.

Next, an outline of the controller 500 of the image forming apparatus is described with reference to FIG. 6.

Figure 6:
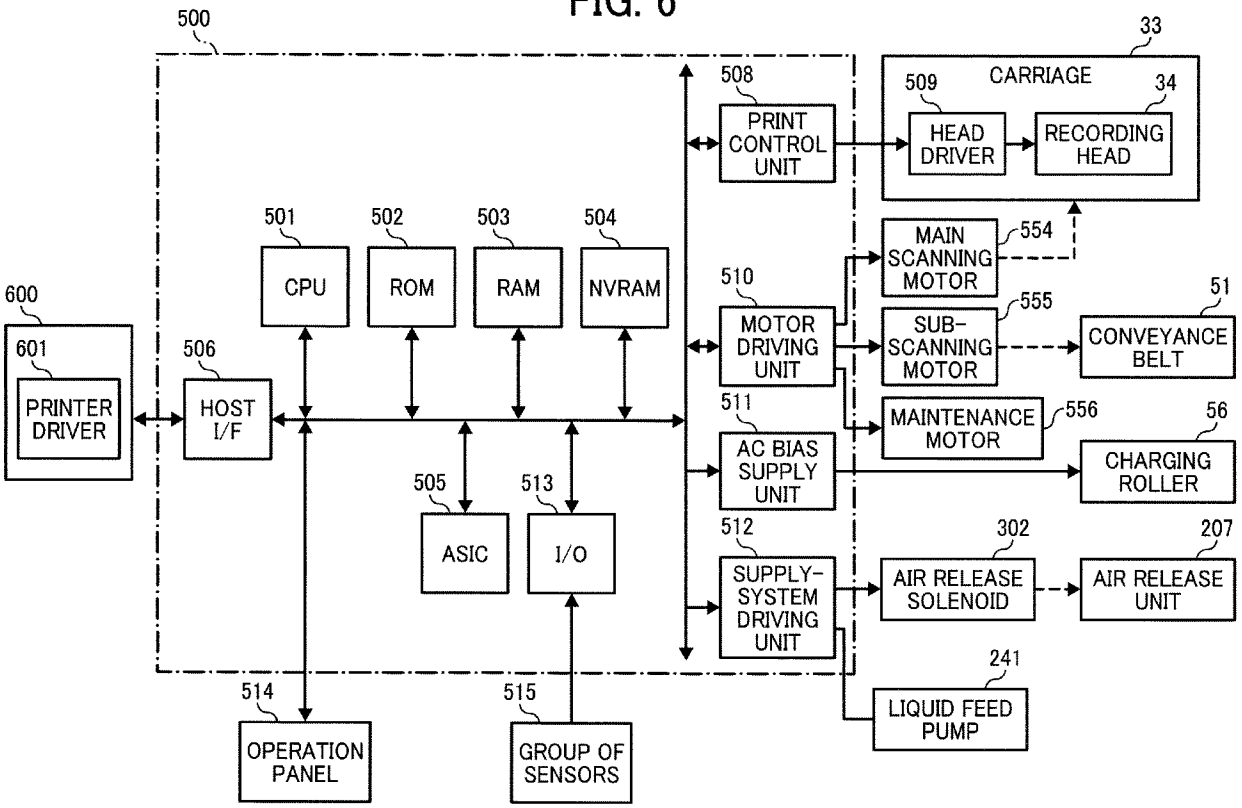
FIG. 6 is a schematic block diagram of a controller according to an exemplary embodiment of this disclosure.

FIG. 6 is a block diagram of the controller 500 of the image forming apparatus according to an exemplary embodiment of this disclosure.

The controller 500 includes a central processing unit (CPU) 501 a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a supply control unit according to exemplary embodiments of this disclosure. The ROM 502 stores programs executed by the CPU 501 and other fixed data, and the RAM 503 temporarily stores image data and other data. The NVRAM 504 is a rewritable memory capable of retaining data even while the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a motor driving unit 510, an alternating current (AC) bias supply unit 511, and a supply-system driving unit 512. The print control unit 508 includes a data transmitter and a driving signal generator to drive and control the recording heads 34 according to print data. The head driver 509 drives the recording heads 34 mounted on the carriage 33. The motor driving unit 510 drives the main scanning motor 554 to move the carriage 33 for scanning, drives the sub-scanning motor 555 to circulate the conveyance belt 51, and drives the maintenance motor 556 of the maintenance device 81. The AC bias supply unit 511 supplies AC bias to the charging roller 56. The supply-system driving unit 512 drives the liquid feed pump 241 and the air release solenoid 302 disposed at the apparatus body 1 to open and close the air release unit 207 of the head tank 35.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the host I/F 506, performs desired image processing, data sorting, or other processing with the ASIC 505, and transfers image data to the head driver 509. Dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. At this time, by selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, the AC bias supply unit 511, and ink supply to the head tanks 35 based on the extracted information.

Besides the carriage-side sensor 251, the body-side sensor 301, and the detection electrode pins 208*a* and 208*b*, the group of sensors 515 includes, for example, an optical sensor to detect the position of the sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, an example of position detection of the displacement member 205 of the head tank 35 is described with reference to FIGS. 7A, 7B, and 8.

Figure 7A:
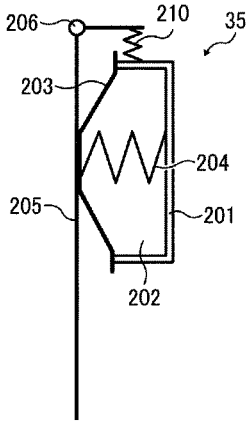
FIGS. 7A and 7B are illustrations showing displacement of a displacement member of the head tank according to an exemplary embodiment of this disclosure.
Figure 7B:
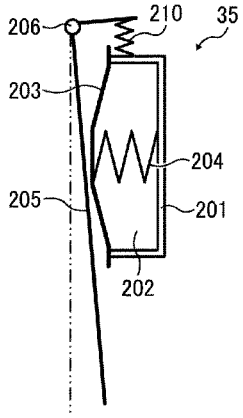

FIGS. 7A and 7B are schematic views of the displacement member 205 of the head tank 35 at different positions. FIG. 8 is an illustration of position detection of the displacement member 205 of the head tank 35. It is to be noted that, in subsequent drawings, the head tank 35 is illustrated in a simplified form like FIGS. 7A, 7B, and 8.

In accordance with the remaining amount of liquid in the head tank 35, the displacement member 205 of the head tank 35 displaces between a position indicated by a solid line in FIG. 7A (i.e., a broken line in FIG. 7B) and a position indicated by a solid line in FIG. 7B.

Figure 8:
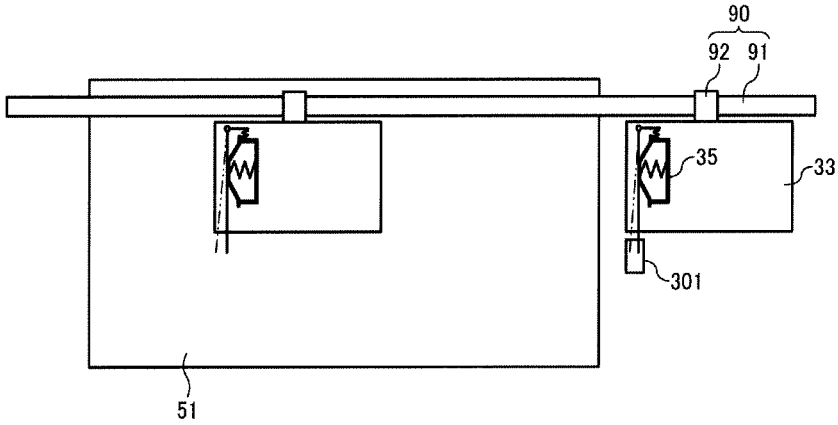
FIG. 8 is an illustration showing detection of the position of the displacement member according to an exemplary embodiment of this disclosure.

As illustrated in FIG. 8, when the body-side sensor 301 at the apparatus body 1 side detects the displacement member 205 of the head tank 35, the linear encoder 90 stores a position of the carriage 33. When the displacement member 205 of the head tank 35 displaces, the carriage 33 continues to move until the body-side sensor 301 detects the displacement member 205 of the head tank 35 again. When the body-side sensor 301 detects the displacement member 205 of the head tank 35 again, the linear encoder 90 reads another position of the carriage 33, thus allowing detection of the positions and displacement amount of the displacement member 205 as a difference between the positions of the carriage.

At this time, if a remaining amount of liquid in the head tank 35 corresponding to an initial position of the displacement member 205 and a liquid amount corresponding to the displacement amount of the displacement member 205 are stored in advance, the remaining amount of liquid in the head tank 35 can be obtained from a detected displacement amount of the displacement member 205.

Hence, for example, when liquid supply to the head tank 35 is controlled by detecting the displacement member 205 of the head tank 35 with the body-side sensor 301, the controller 500 stops printing operation, moves the carriage 33 to a position at which the body-side sensor 301 detects the displacement member 205, and performs liquid supply operation.

Next, an example of acquisition of normal fill position by the body-side sensor and normal filling operation are described with reference to FIGS. 9A to 9L.

FIGS. 9A to 9F are illustrations of acquisition of normal fill position by the body-side sensor and normal filling operation. FIGS. 9A, 9C, 9E, 9G 91, and 9K are schematic side views of the head tank 35. FIGS. 9B, 9D, 9F, 9H, 9J, and 9L are schematic plan views of the head tank 35. Each pair of FIGS. 9A and 9B, 9C and 9D, 9E and 9F, 9G and 9H, 91 and 9J, and 9K and 9L shows the same state.

Figure 9A:
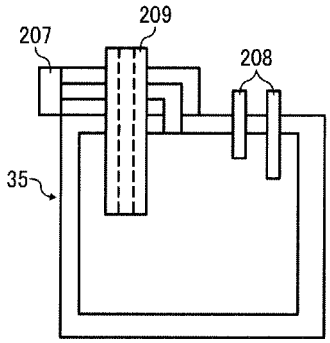
Figure 9B:
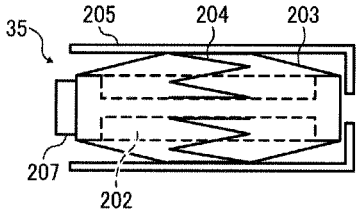
Figure 9C:
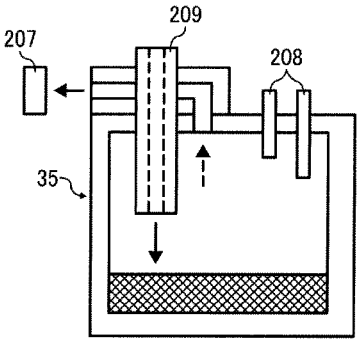
Figure 9D:
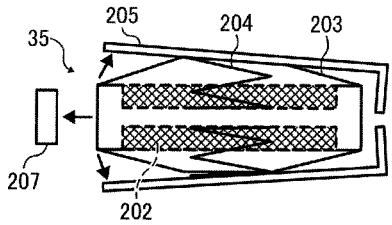
Figure 9E:
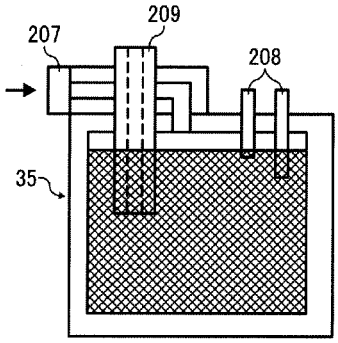
Figure 9F:
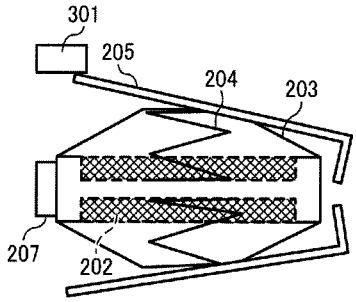

First, from an empty state of the head tank 35 illustrated in FIGS. 9A and 9B, as illustrated in FIGS. 9C and 9D, the air release unit 207 is opened to release air in the head tank 35 to the atmosphere and ink is supplied to the head tank 35. As a result, the displacement member 205 displaces outward (i.e., in a direction away from the tank case 201). As illustrated in FIGS. 9E and 9F, when the electrode pins 208 detect the liquid level of ink, ink supply is stopped and the air release unit 207 is closed. Then, the controller 500 acquires a first position of the displacement member 205 with the body-side sensor 301 and stores the first position of the displacement member 205 as an air release and ink full position (air release position).

Figure 9G:
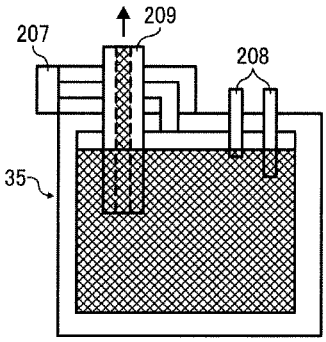
Figure 9H:
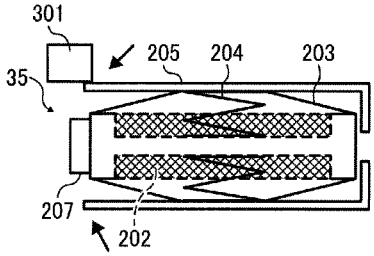
Figure 9I:
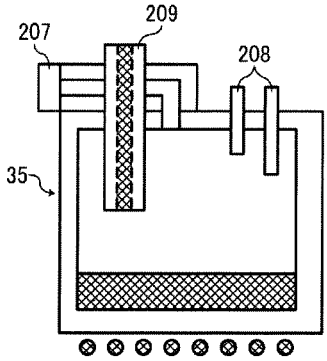

Then, as illustrated in FIGS. 9G and 9H, the liquid feed pump 241 is driven in reverse to feed in reverse and discharge a predetermined amount of ink from the head tank 35 to the main tank 10, thus creating a negative pressure. Then, the controller 500 acquires a second position of the displacement member 205 with the body-side sensor 301 and stores the second position of the displacement member 205 as a normal fill position.

Figure 9J:
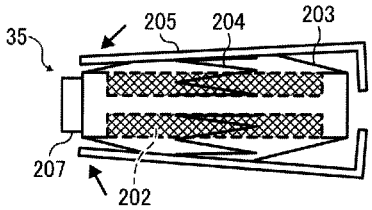

As illustrated in FIGS. 91 and 9J, when the recording head 34 ejects droplets and consumes ink in the head tank 35, the displacement member 205 displaces inward (i.e., in a direction to approach the tank case 201).

Figure 9K:
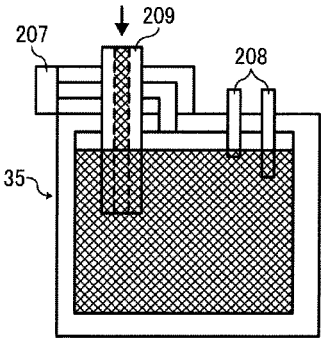
Figure 9L:
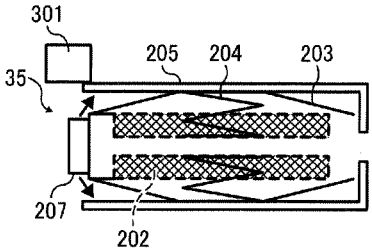

When the consumption amount of ink reaches a threshold consumption amount, as illustrated in FIGS. 9K and 9L, ink is supplied to the head tank 35 until the displacement member 205 arrives at the normal fill position.

The consumption amount of ink is obtained by software-based counting (hereinafter, soft counting) of the amount of liquid droplets (liquid consumption amount) ejected from nozzles of the recording heads 34. The soft counting counts the number of droplets for each of different droplet amounts of liquid droplets ejected and calculates a sum of droplet amounts for different droplet sizes, each obtained by multiplying a droplet amount of each droplet size by the counted number of droplets of each droplet size to determine the liquid consumption amount.

When the ink consumption amount becomes a threshold amount or greater, the carriage 33 is moved to a carriage position stored as the normal fill position and ink supply is performed.

Next, an example of control of acquisition of a normal fill position of the feeler performed by the controller is described with reference to FIG. 10.

At S101, as described above, the air release unit 207 of the head tank 35 is opened to release air to the atmosphere. At S102, ink is supplied (filled) from the main tank 10 to the head tank 35 until the electrode pins 208 detect the liquid level of ink in the head tank 35. At S103, the air release unit 207 is closed. At S104, a first current position (feeler position) of the displacement member 205 is stored as an air release and ink full position (=0).

At S105, ink is discharged (fed in reverse to the main tank 10) from the head tank 35 at a discharge amount "a". At S106, a second current position of the displacement member 205 is stored as a normal fill position 1. At S107, the displacement amount of the displacement member 205 is determined by subtracting the normal fill position 1 from the air release and ink full position 0 and stored as a feeler displacement amount 1.

At S108, the controller 500 determines whether the feeler displacement amount 1 is less than a threshold amount (e.g., 1 mm). When the feeler displacement amount 1 is not less than the threshold amount (NO at S108), at S109 the controller 500 determines that the normal fill position 1 has been normally acquired, and finishes the process. By contrast, when the feeler displacement amount 1 is less than the threshold amount (YES at S108), at S110 the controller 500 determines that acquisition of the normal fill position 1 has failed, and reports an acquisition error.

Next, a comparative example of normal filling control is described with reference to FIG. 11.

When the consumption amount of ink in the head tank 35 is a threshold amount or greater (YES at S201), at 5202 the controller 500 starts normal filling operation (sequence) and at S203 moves the carriage 33 to move the head tank 35 to the normal fill position 1. At S204, the controller 500 determines whether or not the displacement member 205 is detected with the body-side sensor 301.

When the displacement member 205 is detected (YES at S204), at 5209 the controller 500 finishes the normal filling sequence.

By contrast, when the displacement member 205 is not detected (NO at S204), at S205 the liquid feed pump 241 starts to fill ink to the head tank 35 and continues ink filling until the body-side sensor 301 detects the displacement member 205. When the body-side sensor 301 detects the displacement member 205 (YES at S206), at S209 the controller 500 finishes the normal filling sequence. At S207, the controller 500 determines whether or not a threshold time has passed. When the displacement member 205 is not detected within the threshold time (NO at S206 and YES at S207), at S208 the controller 500 determines that the head tank 35 is in an ink end state.

Figure 11:
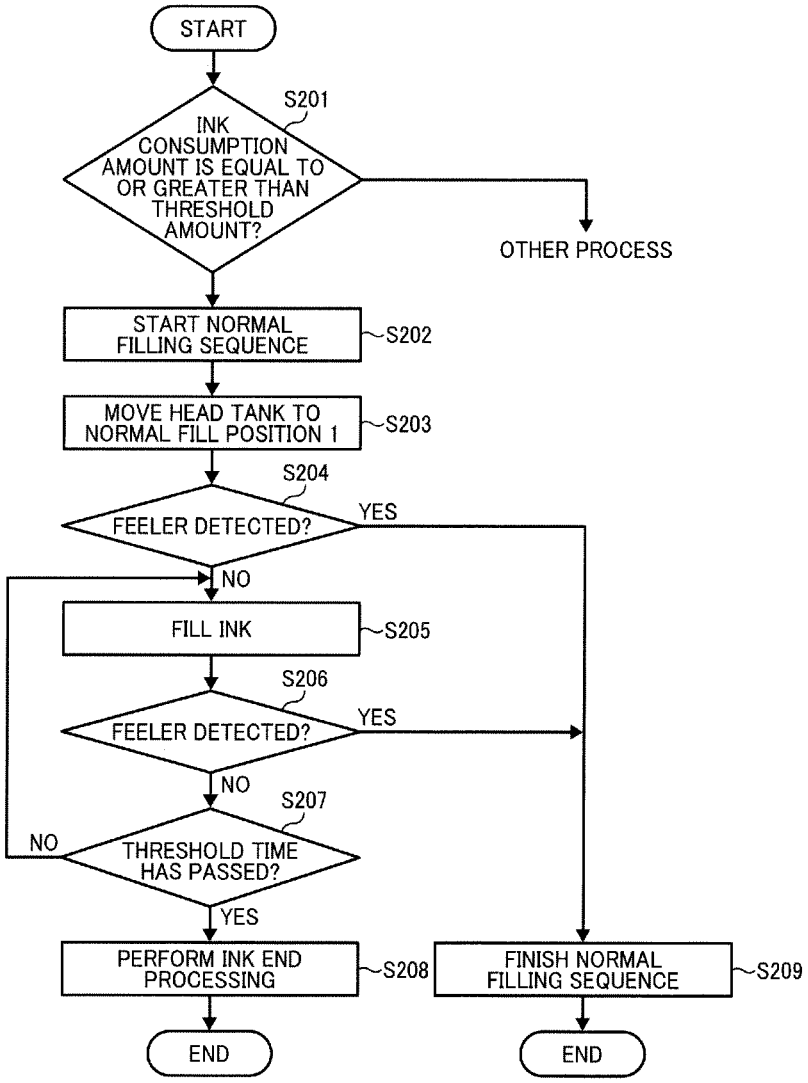
FIG. 11 is a flowchart showing a procedure of control of normal filling operation in a comparative example.

Next, a disadvantage of the normal filling control of the comparative example illustrated in FIG. 11 is described below.

The film member 203 of the head tank 35 has an inner layer (proximal to the ink accommodation part 202) of, e.g., polyethylene to ensure ink resistance and an outer layer of, e.g., nylon to be elastic. Alternatively, the film member 203 of the head tank 35 may have a layer of metal, e.g., aluminum as an inner layer to serve as a barrier against ink.

Here, nylon forming the outer layer absorbs moisture and expands, or dries and contracts with fluctuations of the humidity of the ambient environment, thus fluctuating the air release and ink full position. Meanwhile, the discharge amount "a" of ink for creating a negative pressure does not vary with fluctuations of the humidity. As a result, the normal fill position may vary with fluctuations of the air release and ink full position.

Thus, when the air release and ink full position is near the tank case 201 (in a state in which air is unlikely to be released to the atmosphere), the displacement member 205 contacts the tank case 201 when ink is discharged to create a negative pressure. As a result, when ink is further discharged, the position of the displacement member 205 may not change, i.e., the displacement member 205 may become immovable from the normal fill position.

When the displacement member 205 is detected at the stored normal fill position, ink filling is not performed. Therefore, when ink is actually consumed, ink may not be replenished to the head tank 35. As a result, when ink is repeatedly consumed, the head tank 35 might run short of ink, thus causing non ejection nozzles (a faulty state in which ink droplets are not ejected from one or more nozzles).

The above-described disadvantage is further described with reference to FIGS. 12A to 12L.

FIGS. 12A to 12L are illustrations similar to FIGS. 9A to 9L. FIGS. 12A, 12C, 12E, 12G 121, and 12K are schematic side views of the head tank 35. FIGS. 12B, 12D, 12F, 12H, 12J, and 12L are schematic plan views of the head tank 35. Each pair of FIGS. 12A and 12B, 12C and 12D, 12E and 12F, 12G and 12H, 121 and 12J, and 12K and 12L shows the same state.

Figure 12A:
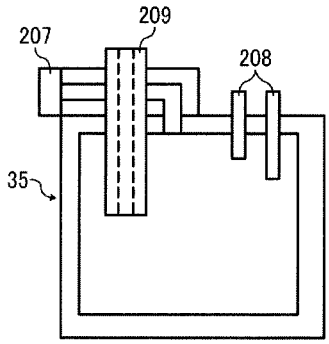
Figure 12B:
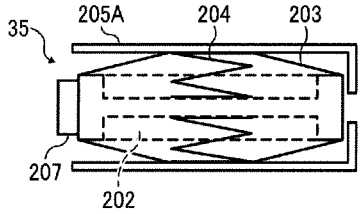
Figure 12C:
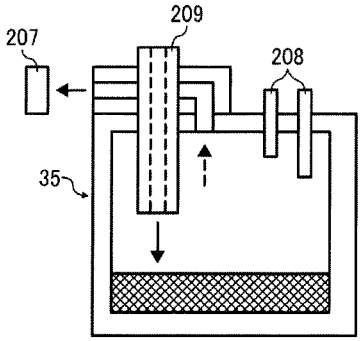
Figure 12D:
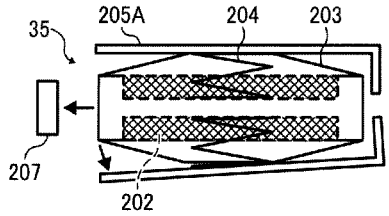

From an empty state of the head tank 35 illustrated in FIGS. 12A and 12B, as illustrated in FIGS. 12C and 12D, the air release unit 207 is opened to release air in the head tank 35 to the atmosphere and ink is supplied to the head tank 35.

As described above, when the air release unit 207 is opened, the displacement member 205 may be less opened outward depending on the state of the film member 203.

Here, the displacement member 205 at an upper side of FIG. 12B-b2 is referred to as displacement member 205A which is in a less opened state (position).

Figure 12E:
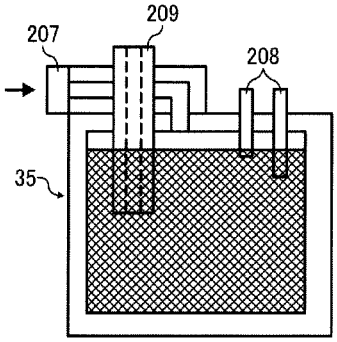
Figure 12F:
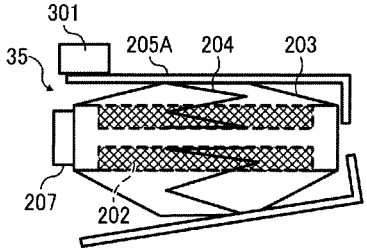

As illustrated in FIGS. 12E and 12F, when the electrode pins 208 detect the liquid level of ink, ink supply is stopped and the air release unit 207 is closed. At this time, when the controller 500 acquires the air release and ink full position of the displacement member 205 with the body-side sensor 301, the less opened position of the displacement member 205 is stored as the air release and ink full position.

Figure 12G:
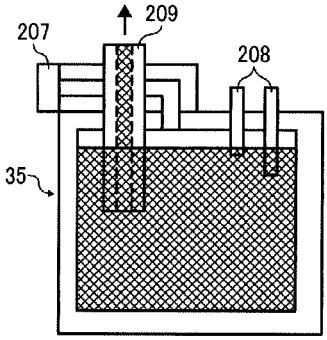
Figure 12H:
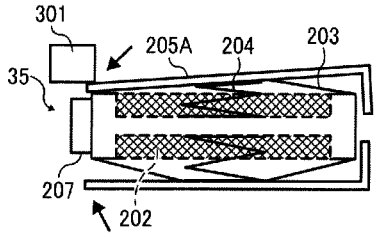
Figure 12I:
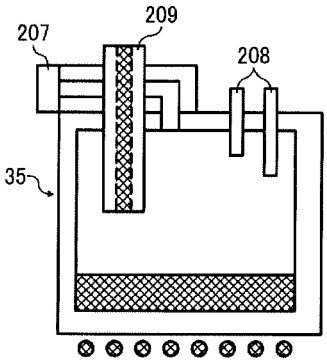

Then, as illustrated in FIGS. 12G and 12H, a predetermined amount of ink is discharged form the head tank 35 to create a negative pressure. At this time, the controller 500 acquires a current position of the displacement member 205A with the body-side sensor 301 and stores the position of the displacement member 205A as a normal fill position 1. However, as described above, since the displacement member 205A at an upper side of FIG. 12H is less opened, a position at which the displacement member 205A contacts the tank case 201 is stored as the normal fill position 1.

Figure 12J:
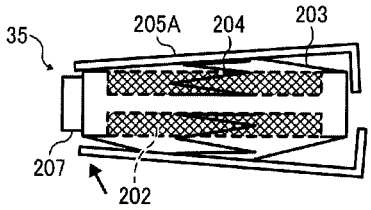

Then, as illustrated in FIGS. 121 and 12J, when the recording head 34 ejects droplets and consumes ink in the head tank 35, the displacement member 205A already contacts the tank case 201 and does not displace further inward (i.e., in the direction to approach the tank case 201).

Figure 12K:
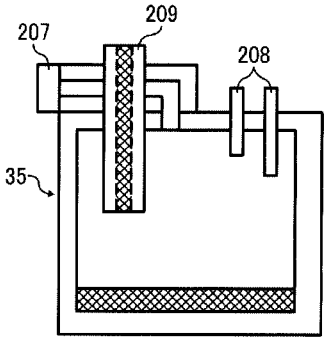
Figure 12L:
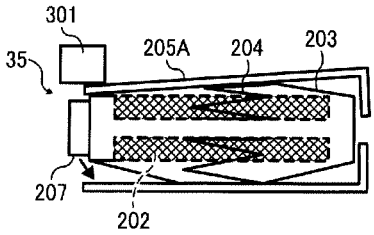

Then, as described above, when the consumption amount of ink becomes a threshold amount, the controller 500 performs normal filling operation. However, as illustrated in FIGS. 12K and 12L, the displacement member 205A does not displace and still is at the normal fill position 1 (in other words, in FIG. 11, the state (YES at S204) in which the feeler (displacement member 25) is detected after the head tank 35 is moved to the normal fill position 1). As a result, the normal filling sequence ends without ink filling.

Next, a procedure of control of normal filling operation performed by the controller according to a first exemplary embodiment of the present disclosure is described with reference to FIG. 13.

When the consumption amount of ink is a threshold amount or greater (YES at S301), at S302 the controller 500 starts normal filling operation (sequence) and at S303 moves the carriage 33 to move the head tank 35 to a normal fill position 1.

At S304, the controller 500 determines whether or not the displacement ember 205 is detected with the body-side sensor 301.

When the displacement member 205 is not detected (NO at S304), like the comparative example of FIG. 11, at S305 the liquid feed pump 241 starts to fill ink to the head tank 35 and continues ink filling until the body-side sensor 301 detects the displacement member 205. When the body-side sensor 301 detects the displacement member 205 (YES at S306), at S309 the controller 500 finishes the normal filling sequence. At S307, the controller 500 determines whether or not a threshold time has passed. When the displacement member 205 is not detected within the threshold time (NO at S306 and YES at S307), at S308 the controller 500 determines that the head tank 35 is in an ink end state.

By contrast, when the head tank 35 is moved to the normal fill position 1 and the body-side sensor 301 detects the displacement member 205 (YES at S304), at S310 the controller 500 replaces a feeler displacement amount 1 with a value obtained by multiplying the feeler displacement amount 1 by 0.9 and stores the value as a feeler displacement amount 2. Thus, the normal fill position is corrected to a position allowing liquid supply.

At S311, the controller 500 determines whether or not the feeler displacement amount 2 is less than a threshold amount (e.g., 1 mm).

When the feeler displacement amount 2 is not less than the threshold amount (NO at S311), at S312 the controller 500 replaces the normal fill position 1 with a position obtained by subtracting the feeler displacement amount 2 from the air release and ink full position 0 and returns to S303 to move the head tank 35 to the replaced normal fill position 1.

By contrast, when the feeler displacement amount 2 is less than the threshold amount (YES at S311), at S313 the controller 500 determines that acquisition of the normal fill position 1 has failed, and reports an acquisition error.

As described above, when the displacement member 205 is detected during normal filling operation, the controller 500 performs control to rewrite (correct) the normal fill position. Such a configuration can prevent consumption of ink in the head tank 35 without performing normal filling, thus preventing occurrence of non-ejection nozzles.

For such a configuration, as described above, the replacement value is not a fixed value but calculated from the first acquired feeler displacement amount. This is because the air release and ink full position and the feeler displacement amount vary with variations among actual apparatuses and environmental variations. Hence, in this exemplary embodiment, the controller 500 acquires a current value as the replacement value without using a fixed value, thus preventing influences of such variations.

In addition, if the feeler displacement amount is too small, the negative pressure in the head tank 35 may become too weak, thus causing ink leakage. Hence, in this exemplary embodiment, the controller 500 determines an error by comparing the feeler displacement amount with a threshold amount.

Next, a procedure of control of normal filling operation performed by the controller according to a second exemplary embodiment of the present disclosure is described with reference to FIG. 14.

Figure 13:
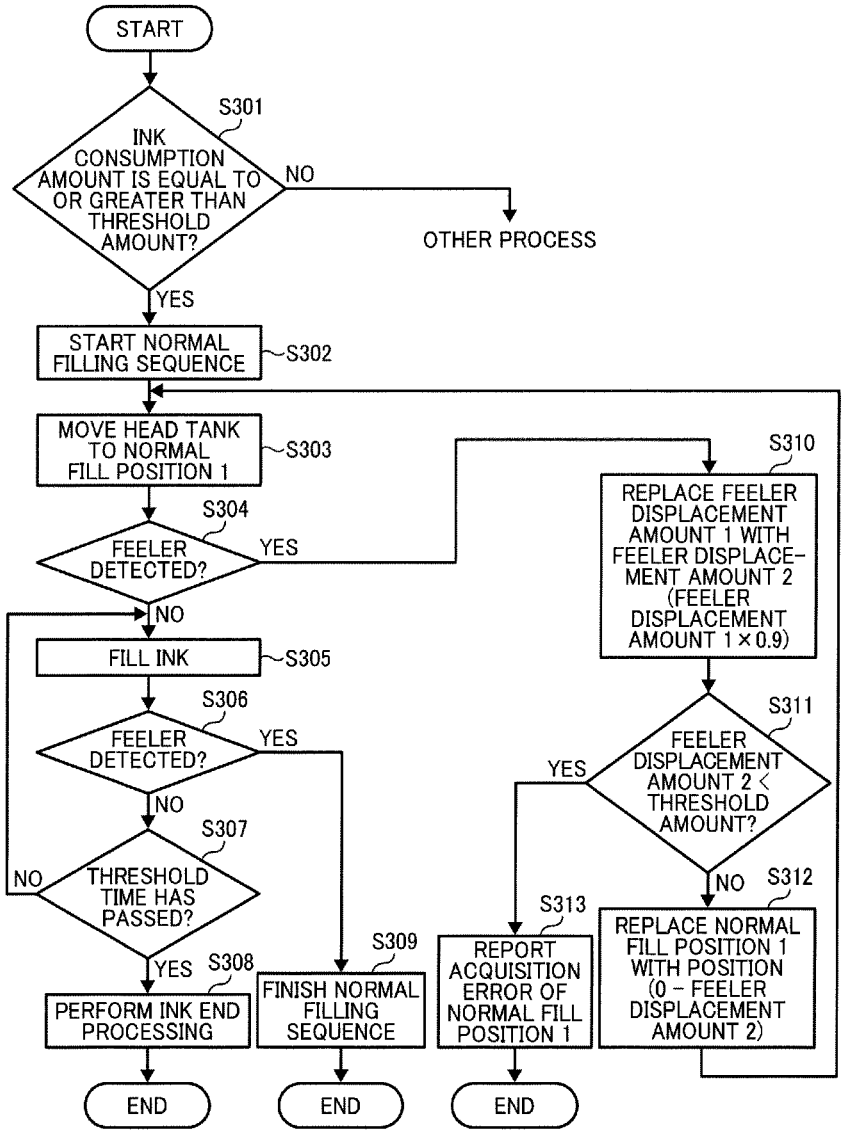
FIG. 13 is a flowchart showing a procedure of control of normal filling operation performed by the controller according to a first exemplary embodiment of this disclosure.
Figure 14:
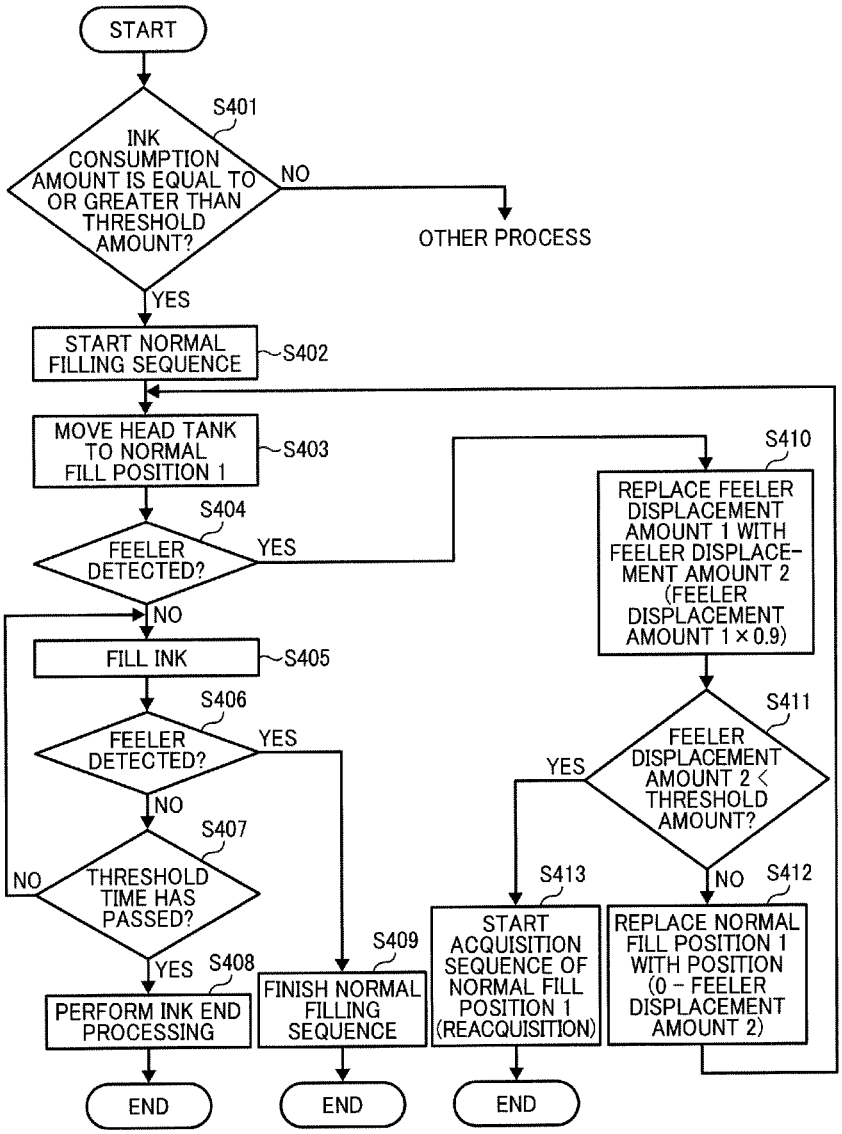
FIG. 14 is a flowchart showing a procedure of control of normal filling operation performed by the controller according to a second exemplary embodiment of this disclosure.

Steps S401 to S412 of this second exemplary embodiment illustrated in FIG. 14 are similar to the steps S301 to S312 of the first exemplary embodiment illustrated in FIG. 13. The procedure of this second exemplary embodiment illustrated in FIG. 14 differs from that of the first exemplary embodiment illustrated in FIG. 13 in that, when the feeler displacement amount 2 is less than a threshold amount (YES at S411 in FIG. 14 equivalent to S311 in FIG. 13), at S413 the controller 500 performs the acquisition sequence of the normal fill position 1 illustrated in FIG. 11 again, instead of determining that acquisition of the normal fill position 1 has failed.

In other words, with the air release unit 207 opened, the controller 500 performs ink filling while using the electrode pins 208 and acquires the normal fill position 1 again.

Like the procedure of the first exemplary embodiment, such a control procedure can prevent normal filling operation from being not conducted when the head tank 35 is moved to the normal fill position 1 and the displacement member 205 is detected. As a result, such a control procedure can prevent ink in the head tank 35 from being consumed without conducting the normal filling operation, thus preventing occurrence of non-ejection nozzles.

Next, a procedure of control of normal filling operation performed by the controller according to a third exemplary embodiment of the present disclosure is described with reference to FIG. 15.

Figure 15:
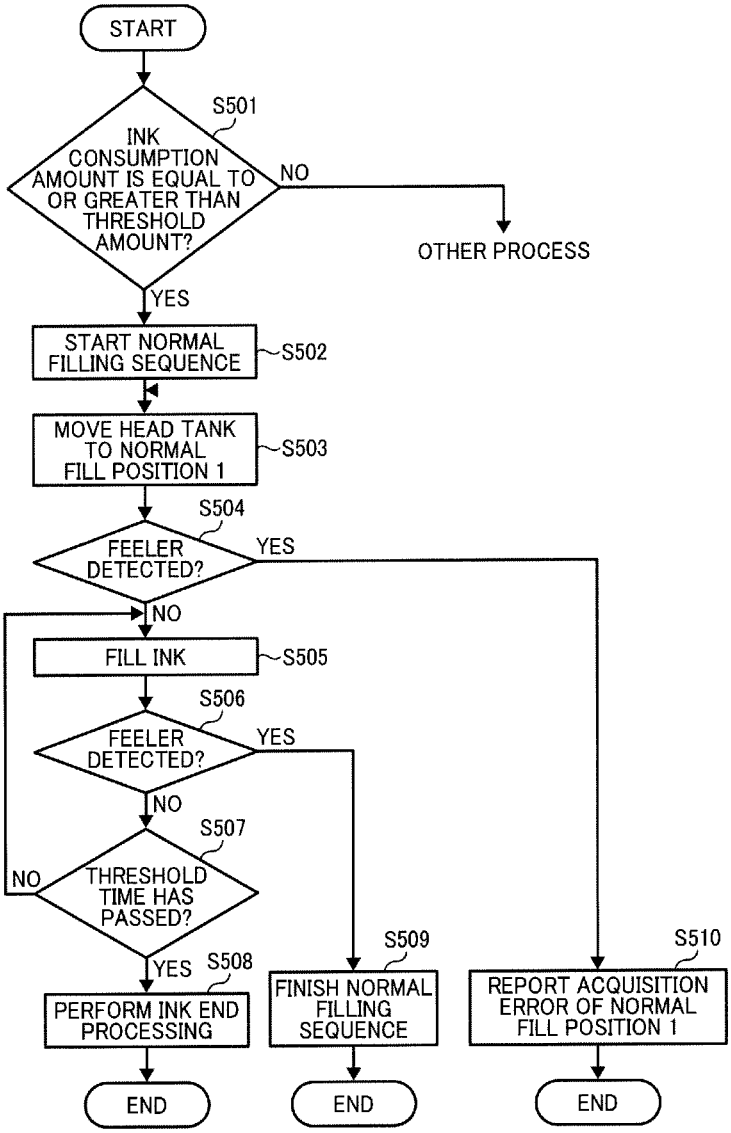
FIG. 15 is a flowchart showing a procedure of control of normal filling operation performed by the controller according to a third exemplary embodiment of this disclosure.

Steps S501 to S509 of this third exemplary embodiment illustrated in FIG. 15 are similar to the steps S201 to S209 of the comparative example illustrated in FIG. 11. The procedure of this third exemplary embodiment illustrated in FIG. 15 differs from that of the comparative example illustrated in FIG. 11 in that, when the head tank 35 is moved to the normal fill position 1 and the displacement member 205 is detected (YES at S504 in FIG. 15 corresponding to S204 in FIG. 11), at S510 the controller 500 determines that acquisition of the normal fill position 1 has failed, and reports an acquisition error.

Such a control procedure can prevent normal filling operation from being not conducted when the head tank 35 is moved to the normal fill position 1 and the displacement member 205 is detected. As a result, such a control procedure can prevent ink in the head tank 35 from being consumed without conducting the normal filling operation, thus preventing occurrence of non-ejection nozzles.

Next, a procedure of control of normal filling operation performed by the controller according to a fourth exemplary embodiment of the present disclosure is described with reference to FIGS. 16 and 17.

Figure 16:
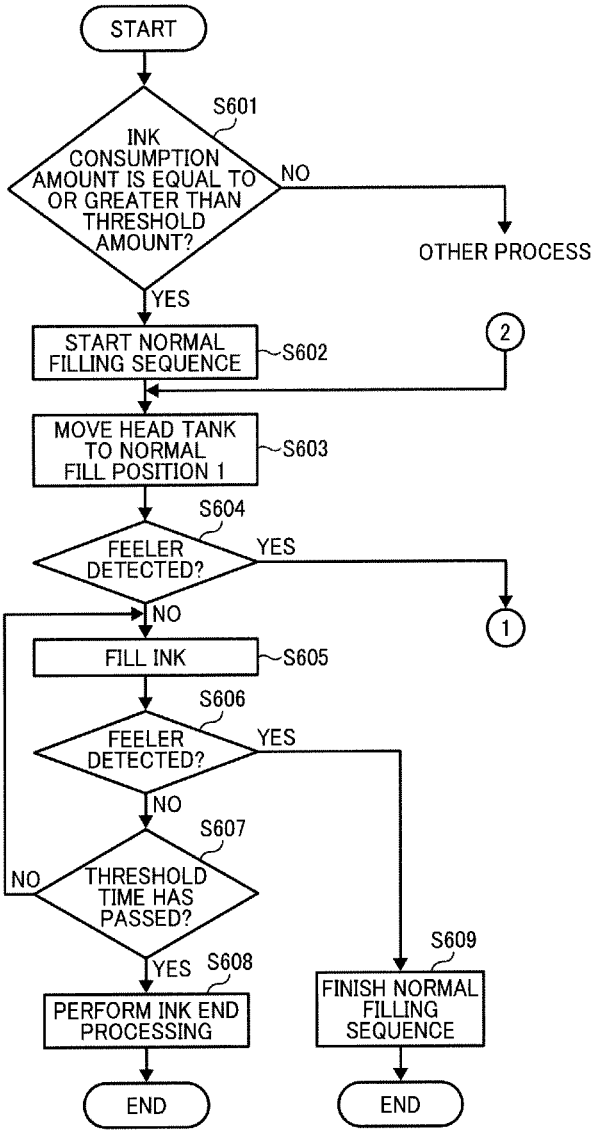
FIG. 16 is a flowchart showing a procedure of control of normal filling operation performed by the controller according to a fourth exemplary embodiment of this disclosure.

Steps S601 to S609 of this fourth exemplary embodiment illustrated in FIG. 16 are similar to the steps S201 to S209, respectively, of the comparative example illustrated in FIG. 11. The procedure of this fourth exemplary embodiment illustrated in FIG. 16 differs from the comparative example illustrated in FIG. 11 in that, when the head tank 35 is moved to the normal fill position 1 and the displacement member 205 is detected (YES at S604 corresponding to S204 in FIG. 11), the controller 500 performs the acquisition sequence of the normal fill position 1 again. In addition, in the reacquisition sequence, the controller 500 performs a correction to reduce the discharge amount of ink for creating a negative pressure.

Figure 17:
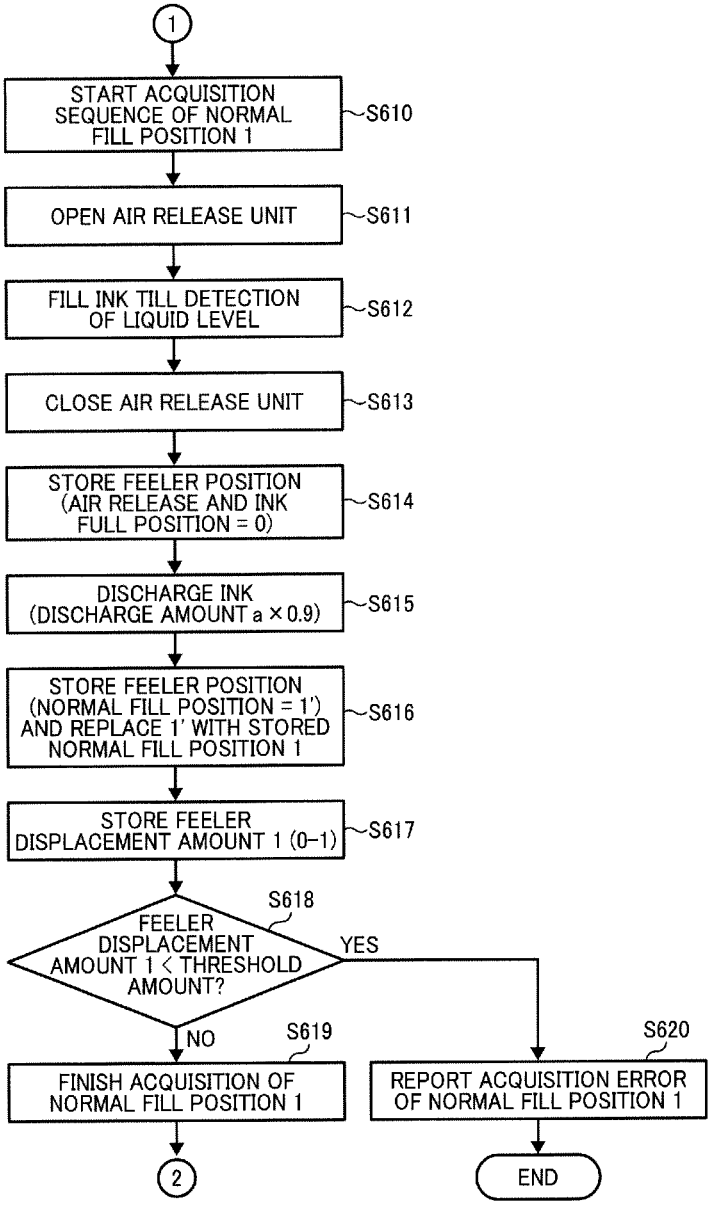
FIG. 17 is a flowchart of an acquisition sequence of a normal fill position 1 serving as a part of the control procedure illustrated in FIG. 16.

In other words, when the head tank 35 is moved to the normal fill position 1 (S603) and the displacement member 205 is detected (YES at S604), as illustrated in FIG. 17, at S610 the controller 500 starts the acquisition sequence of the normal fill position 1. Like the sequence illustrated in FIG. 11, at S611 the air release unit 207 is opened, and at S612 the liquid feed pump 241 feeds ink to the head tank 35 until the electrode pins 208 detect the liquid level of ink in the head tank 35. At S613 the air release unit 207 is closed, and at S614 the controller 500 stores a first current position of the displacement member 205 as an air release and ink full position 0.

At S615, the controller 500 corrects the ink discharge amount from the first discharge amount "a" to a second discharge amount obtained by multiplying the first discharge amount "a" by 0.9 and discharges the second discharge amount of ink from the head tank 35. At 5616, the controller 500 stores a second current position of the displacement member 205 as a normal fill position 1' and replaces the normal fill position 1' with the stored normal fill position 1.

Figure 10:
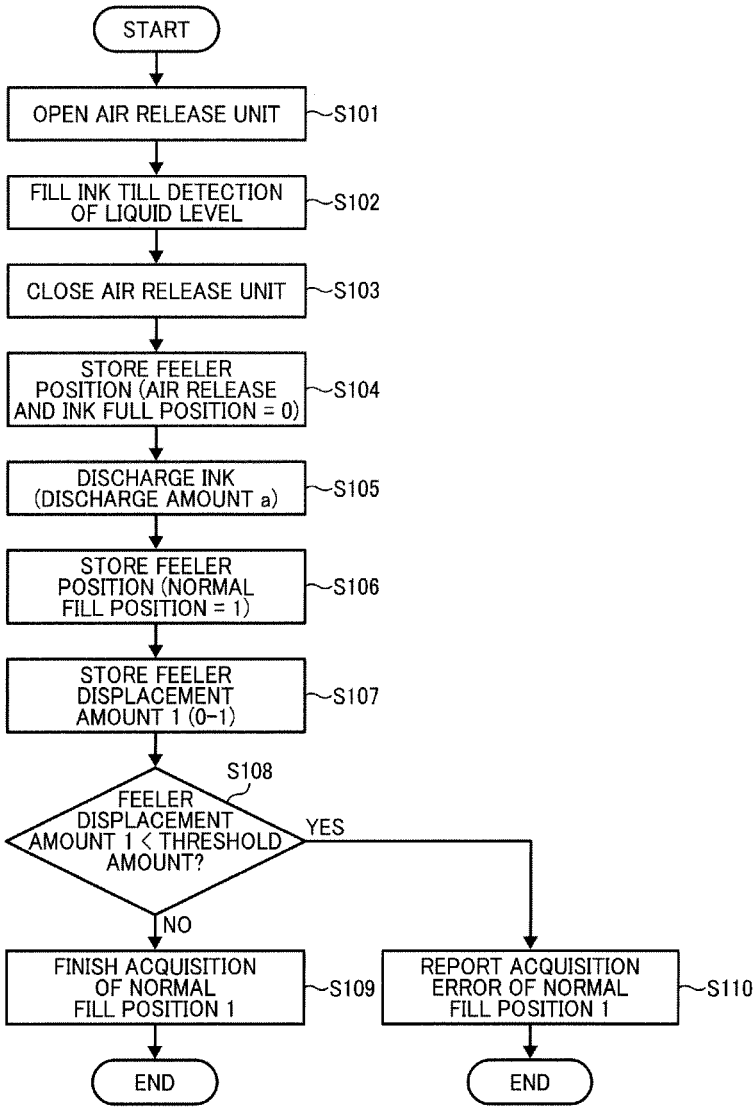
FIG. 10 is a flowchart showing an example of control of acquisition of a normal fill feeler position performed by the controller.

At S617, the controller 500 stores a feeler displacement amount 1 in the same way as S107 of FIG. 10. When the feeler displacement amount 1 is a threshold amount or greater (YES at S618), at S619 the controller 500 finishes the acquisition sequence of normal fill position and the process goes to S603 of FIG. 16. By contrast, when the feeler displacement amount 1 is less than the threshold amount (NO at S618), at S620 the controller 500 determines that acquisition of the normal fill position has failed, and reports an acquisition error.

As described above, in the reacquisition of the normal fill position, the controller 500 makes a correction to reduce the ink discharge amount, thus setting the normal fill position so that normal ink filling can be more reliably performed.

Next, procedures of control of acquisition of normal fill position and normal filling operation performed by the controller according to a fifth exemplary embodiment of the present disclosure are described with reference to FIGS. 18 and 19. In this fifth exemplary embodiment, besides the above-described normal fill position 1, the controller 500 stores, as a normal fill position 2, a position corresponding to a displacement amount (e.g., half of a maximum displacement amount) having a predetermined ratio (intermediate position) relative to the maximum displacement amount of the displacement member 205 in advance. When the head tank 35 is moved to the normal fill position 1 and the displacement member 205 is detected, the controller 500 moves the head tank 35 from the normal fill position 1 to the normal fill position 2 and performs normal ink filling.

Figure 18:
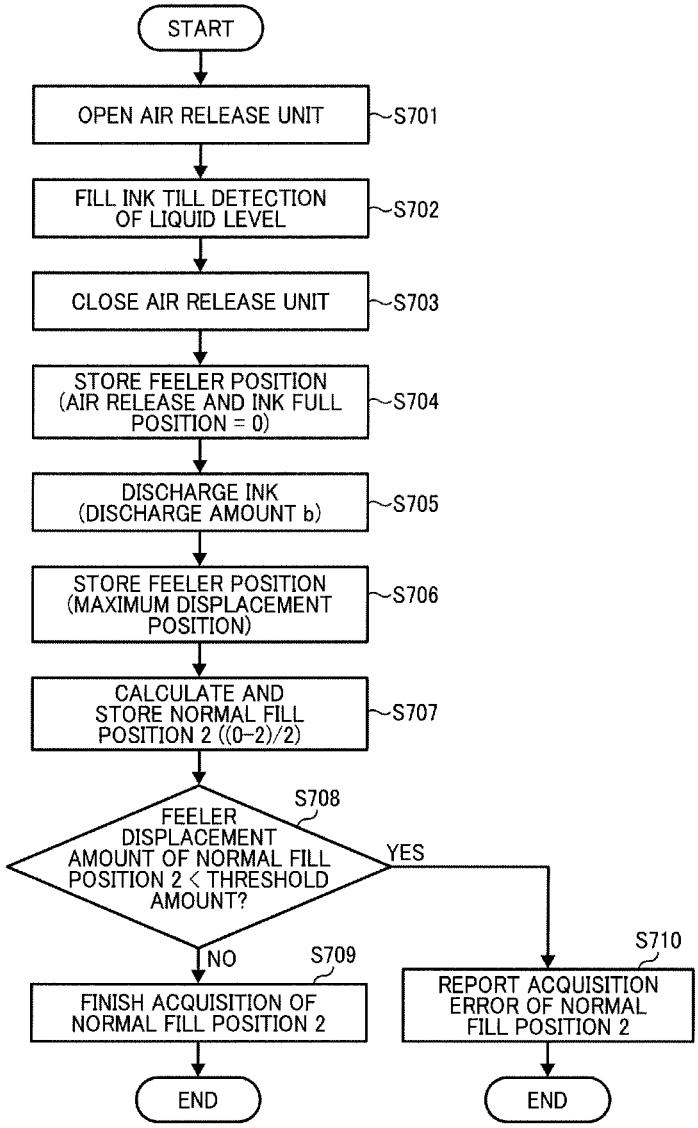
FIG. 18 is a flowchart showing a procedure of control of acquisition of normal fill position performed by the controller according to a fifth exemplary embodiment of this disclosure.

Specifically, in an acquisition sequence of the normal fill position 2 illustrated in FIG. 18, at S701 the air release unit 207 is opened to release air in the head tank 35 to the atmosphere. With the air release unit 207 opened, at S702 the liquid feed pump 241 feeds ink to the head tank 35 until the electrode pins 208 detect the liquid level of ink in the head tank 35. At S703 the air release unit 207 is closed, and at S704 the controller 500 stores a first corrent position of the displacement member 205 as an air release and ink full position 0.

At S705, the controller 500 discharges ink from the head tank 35 (feeds ink in reverse to the main tank 10) at a predetermined discharge amount "b" which allows confirmation of a maximum displacement amount of the displacement member 205. At S706, the controller 500 stores a second current position of the displacement member 205 as a maximum displacement position (=2).

At S707, the controller 500 calculates half of a value obtained by subtracting the maximum displacement amount 2 from the air release and ink full position 0 and stores the calculated value as the normal fill position 2.

At S708, the controller 500 determines whether or not the normal fill position 2 (feeler displacement amount) is less than a threshold amount (e.g., 1 mm). When the normal fill position 2 is not less than the threshold amount (NO at S708), at S709 the controller 500 finishes the acquisition sequence of the normal fill position 2. By contrast, when the normal fill position 2 is less than the threshold amount (YES at S708), at S710 the controller 500 determines that acquisition of the normal fill position 2 has failed, and reports an acquisition error.

Figure 19:
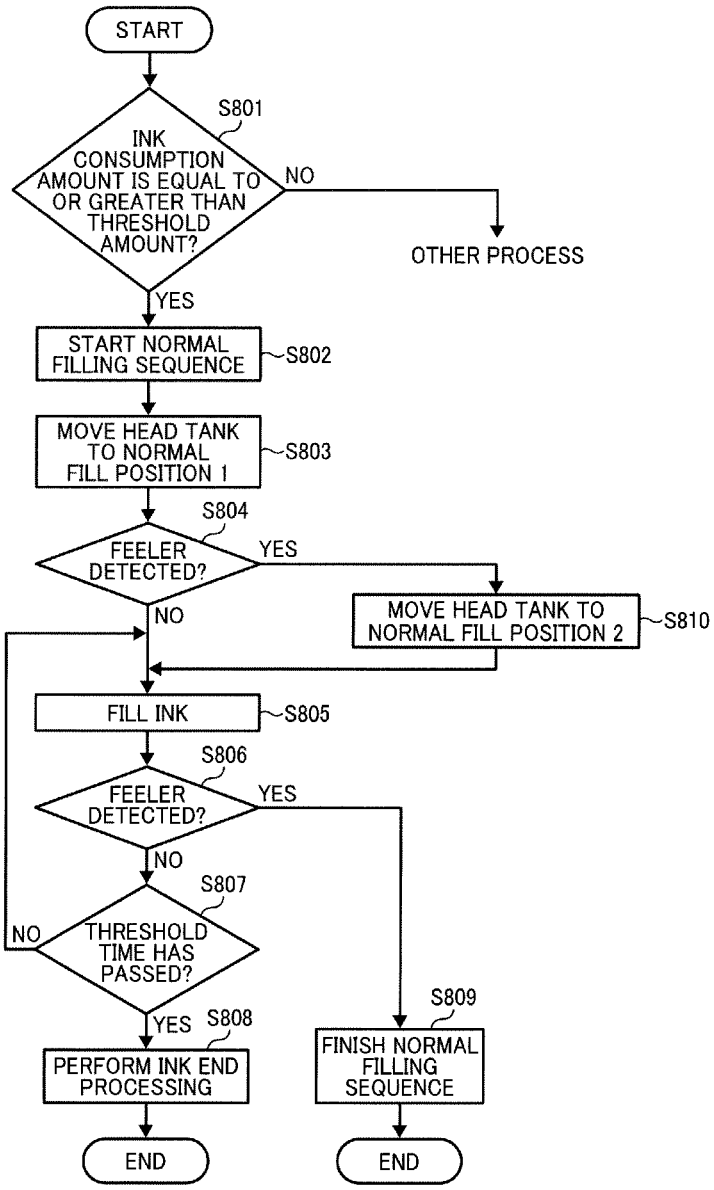
FIG. 19 is a flowchart showing a procedure of control of normal filling operation performed by the controller according to the fifth exemplary embodiment of this disclosure.

In FIG. 19, when the consumption amount of ink in the head tank 35 is a threshold amount or greater (YES at S801), at S802 the controller 500 starts normal filling operation (sequence). When the head tank 35 is moved to the normal fill position 1 (S803) and the displacement member 205 is detected (YES at S804), at S810 the controller 500 moves the carriage 33 to move the head tank 35 to the normal fill position 2 and at S805 performs ink supply while using the normal fill position 2 as the normal fill position. When the body-side sensor 301 detects the displacement member 205 (YES at S806), at S809 the controller 500 finishes the normal filling sequence. When the displacement member 205 is not detected within the threshold time (NO at S806 and YES at S807), at S808 the controller 500 determines that the head tank 35 is in an ink end state.

Such a control procedure can prevent normal ink filling from being not conducted when the head tank 35 is moved to the normal fill position 1 and the displacement member 205 is detected. As a result, such a control procedure can prevent ink in the head tank 35 from being consumed without conducting the normal filling operation.

As described above, in this fifth exemplary embodiment, the normal fill position 1 and the normal fill position 2 are used. In one exemplary embodiment, normal filling operation may be performed with the normal fill position 2 without using the normal fill position 1.

Programs causing a computer or processor to execute the above-described control procedures (processes) are stored in, e.g., the ROM 502. Such programs may be downloaded to an information processing device (e.g., the host 600) and installed to the image forming apparatus. For example, an image forming apparatus according to any one of the above-described exemplary embodiments may be combined with an information processing device to form an image forming system. Alternatively, an information processing device including such programs causing a computer to execute control according to any of the above-described exemplary embodiments may be combined with an image forming apparatus to form an image forming system.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an apparatus body;

a recording head to eject droplets of liquid;

a head tank mounted to the recording head to store the liquid therein and supply the liquid to the recording head, a displacement member disposed at the head tank and displaceable with a remaining amount of the liquid in the head tank;

an air release unit disposed at the head tank to open an interior of the head tank to an atmosphere;

a main tank removably mounted to the apparatus body to store the liquid therein and supply the liquid to the head tank;

a liquid feed device to feed the liquid from the main tank to the head tank;

a body-side detector disposed at the apparatus body to detect the displacement member;

a supply controller to control the liquid feed device to supply the liquid from the main tank to the head tank;

wherein the supply controller controls a normal fill position acquisition operation to open the air release unit, feed the liquid to the head tank with the interior of the head tank open to the atmosphere, discharge a predetermined amount of the liquid from the head tank, detect with the body-side detector a current position of the displacement member after the predetermined amount of the liquid is discharged from the head tank, and retain the detected current position of the displacement member as a normal fill position, wherein the supply controller further controls a normal filling operation to start feeding the liquid from the main tank to the head tank without opening the air release unit when a consumption amount of the liquid in the head tank is a threshold amount or greater, and stop feeding the liquid from the main tank to the head tank when the body-side detector detects an arrival of the displacement member at the normal fill position, and wherein, when the body-side detector detects the displacement member at a start of the normal filling operation, the supply controller corrects the normal fill position to a position at which the liquid feed device can feed the liquid to the head tank.

2. An image forming apparatus comprising:

an apparatus body;

a recording head to eject droplets of liquid;

a head tank mounted to the recording head to store the liquid therein and supply the liquid to the recording head, a displacement member disposed at the head tank and displaceable with a remaining amount of the liquid in the head tank;

an air release unit disposed at the head tank to open an interior of the head tank to an atmosphere;

a main tank removably mounted to the apparatus body to store the liquid therein and supply the liquid to the head tank;

a liquid feed device to feed the liquid from the main tank to the head tank;

a body-side detector disposed at the apparatus body to detect the displacement member;

a supply controller to control the liquid feed device to supply the liquid from the main tank to the head tank;

wherein the supply controller controls a normal fill position acquisition operation to open the air release unit, feed the liquid to the head tank with the interior of the head tank open to the atmosphere, discharge a first predetermined amount of the liquid from the head tank, detect with the body-side detector a current position of the displacement member after the first predetermined amount of the liquid is discharged from the head tank, and retain the detected current position of the displacement member as a normal fill position, wherein the supply controller further controls a normal filling operation to start feeding the liquid from the main tank to the head tank without opening the air release unit when a consumption amount of the liquid in the head tank is a threshold amount or greater, and stop feeding the liquid from the main tank to the head tank when the body-side detector detects an arrival of the displacement member at the normal fill position, and wherein, when the body-side detector detects the displacement member at a start of the normal filling operation, the supply controller controls a reacquisition operation to acquire the normal fill position again.

3. The image forming apparatus of claim 2, wherein, in the reacquisition operation, the supply controller causes the liquid feed device to discharge the liquid from the head tank at a second predetermined amount smaller than the first predetermined amount.

* * * * *